United States Patent [19]

Dickinson

[11] 4,356,837

[45] Nov. 2, 1982

[54] SELF-CLEANING ORIFICE ASSEMBLY

[75] Inventor: John D. Dickinson, Springfield Township, Delaware County, Pa.

[73] Assignee: Westinghouse Electric Corp., Pittsburgh, Pa.

[21] Appl. No.: 151,859

[22] Filed: May 21, 1980

[51] Int. Cl.[3] ..... B08B 3/04

[52] U.S. Cl. ..... 137/238; 134/166 C; 138/41; 138/44; 251/61.4; 251/118; 251/319; 137/625.3

[58] Field of Search ..... 137/237, 238, 239, 625.3; 251/61.4, 61.3, 61.5, 205, 118, 120, 319; 138/41, 44; 134/104, 116, 166 C, 166 R, 171; 239/112, 113

[56] References Cited

U.S. PATENT DOCUMENTS

| | | | |
|---|---|---|---|
| 2,372,920 | 4/1945 | Wiles | 137/239 |
| 2,458,230 | 1/1949 | Warcup | 137/238 |
| 2,786,487 | 3/1957 | Spence | 251/61.4 |
| 2,876,790 | 3/1959 | Nelson | 137/238 |
| 3,025,871 | 3/1962 | Roth et al. | 137/238 |
| 3,513,864 | 5/1970 | Self | 251/205 |

*Primary Examiner*—George L. Walton
*Attorney, Agent, or Firm*—F. J. Baehr, Jr.

[57] ABSTRACT

A self-cleaning orifice assembly, for draining unacceptable accumulations of water from pipes and vessels associated with a turbine, is herein presented and claimed. The invention includes a two-position, movable stem having therein a plurality of ducts and the orifice. Their relative diameters and the flow itself are utilized to prevent blockage of the flow path.

11 Claims, 4 Drawing Figures

SELF-CLEANING ORIFICE ASSEMBLY

BACKGROUND OF THE INVENTION

This invention relates to steam turbines, and more particularly to a positive drain for associated power plant piping and vessels which must be drained of water to prevent possible damage to the turbine.

The number of incidents of water induction into steam turbines has demonstrated the importance of proper drainage of pipes and vessels in both the primary and secondary cycles of power plants. Certain extraction piping and feedwater heater bleed piping from the turbine should be provided with positive drains to prevent accumulation of water therein. If allowed to accumulate, the water may flow back into the turbine, or flash due to a reduction of pressure resulting from a loss of load on the generator, and cause water or cold steam to enter the turbine.

There are numerous methods of keeping turbine pipes and vessels free of unacceptable accumulations of water. First the water may be drained continuously by keeping a valve open during periods when water is expected to be present; or by use of a continuously open drain, orificed to minimize steam flow when water is not present. Second, the water may be drained after a predetermined amount accumulates in a level-controlled drain pot. This method utilizes a level switch or level controller which actuates a power operated valve located in a drain line. The drain line is the line which runs from the drain pot to a vessel which receives the drainage, such as a condenser. Third, the water may be prevented from accumulating through the use of heated pipes and vessels. This is done, for example, by discharging a continuous flow of hot steam through a small orifice in the vessel to a lower pressure zone. The orifice is sized to pass just enough steam to heat the vessel and prevent condensation.

In these methods, orifices are used to reduce the loss of high energy steam through drains. However, a major problem with orifices in drain lines is that they are easily plugged by debris present in the primary and secondary cycles of a power plant. This is especially true during initial startup, and during startups subsequent to maintenance involving disassembly of equipment. However, even when equipment is not disassembled, the products of wear, corrosion, and erosion, such as hard particle erosion can plug orifices. This problem can become acute in systems using small orifices in conjunction with high pressure sources, such as in the heated pipe method described above.

One attempt at relieving this problem was the development of a coarse strainer integral with an orifice and combined in a plug assembly. The plug assembly was installed in a block so that the orifice could be cleaned periodically. A disadvantage with such strainers is that they themselves may become blocked by debris, necessitating their removal, cleaning and rewelding into place. This tends to be expensive and time consuming, and therefore undesirable.

Another solution to the problem was a plug-resistant orifice assembly that could be cleaned by reversing the flow without disassembly. U.S. Pat. No. 3,792,719, assigned to Westinghouse Electric Corporation, was issued on a pair of valves incorporating two valve stems and capable of reversing the flow through a flow restriction.

SUMMARY OF THE INVENTION

In general, a self-cleaning orifice assembly when made in accordance with this invention comprises a flow restricting device such as an orifice, and a device employing a single valve stem for reversing the flow through the orifice whenever cleaning is desired. This is accomplished through the use of a two position valve stem. In a first position fluid flows from an inlet chamber; through the valve stem via a plurality of feed holes, an axial bore, a flow restricting device, and an escape hole; and then into the outlet chamber. When the valve is actuated, automatically or manually, the valve stem is moved and seated into its second position. In this position the fluid flows from the intake chamber; through the valve stem via a cleaning port, the axial bore and the feed holes; and into the outlet chamber. Thus, in the second or cleaning position the feed holes are cleaned of debris. In addition, when the stem is in this second position, a parallel flow path permits the fluid to enter the cleaning port and discharge through the end of the axial bore into a cap chamber, and thereafter to exit through a cap outlet. This cleans the chamber immediately below the valve stem, eliminating debris which may gather there and prevent the stem discs from seating properly.

BRIEF DESCRIPTION OF THE DRAWINGS

The objects and advantages of this invention will become more apparent from reading the following detailed description in connection with the accompanying drawings, in which.

DESCRIPTION OF THE PREFERRED EMBODIMENT

Figure 1:
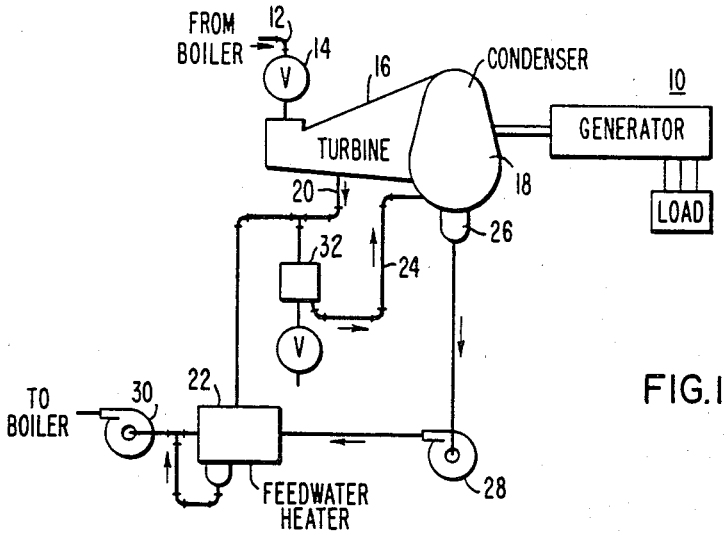
FIG. 1 is a flow diagram of a turbogenerator unit incorporating a self-cleaning orifice assembly made in accordance with this invention.

Referring now to the drawings in detail, like reference numerals refer to like features. FIG. 1 shows a flow diagram of a turbogenerator 10, wherein motive steam from a boiler (not shown) flows through a supply conduit 12 and stop valve 14 to a turbine 16, and is exhausted to a condenser 18. Extraction or bleed steam is withdrawn from the motive steam through extraction piping or conduit 20 to some intermediate stage of the turbine 16 in order to provide the steam for feedwater heater 22, which heats the condensate being returned to the boiler. A drain pipe or conduit 24 is disposed between the extraction piping 20 and the condenser 18, and contains a self-cleaning orifice assembly 32, which will be described in detail hereinafter. Condensate collected in a hot well 26 of the condenser 18 is pumped from the condenser 18 to the feedwater heater 22 by a condensate pump 28. The condensate then flows through the tubes of the feedwater heater 22, and is picked up by a boiler feed pump 30, and pumped to the boiler where it is again converted to motive steam. While the flow diagram only shows a single self-cleaning orifice assembly 32, it is understood that a plurality of such devices would be utilized in an operational system for a turbogenerator.

Figure 2:
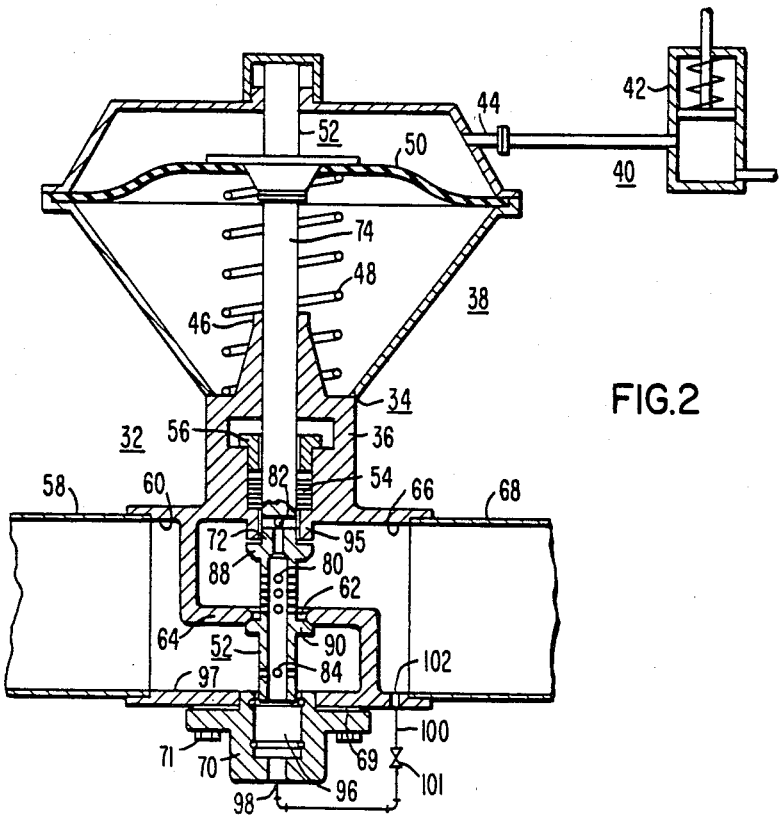
FIG. 2 is a sectional view of a valve system incorporating the invention, with the valve stem in its cleaning position.
Figure 3:
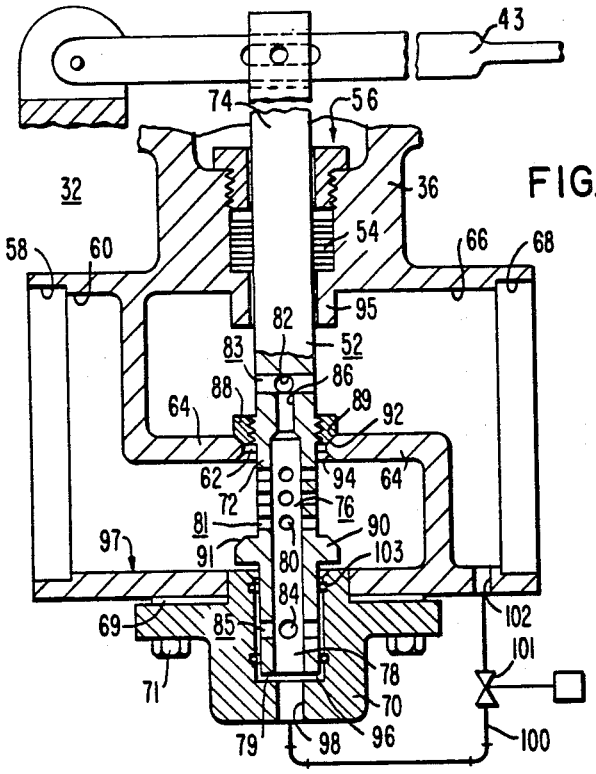
FIG. 3 is an enlarged view of the valve body shown in FIG. 2, but having its valve stem in its normal operating position.

As shown in FIG. 2, the invention is incorporated into a valve 32 operable manually or by auxiliary power such as electricity, compressed air, or hydraulic pressure. A valve casing or house 34, including a valve box or body 36 and a spring housing 38, is fitted to an actuator 40 such as an air actuator 42 shown in the drawing. The actuator 40 may also, for example, be a handle 43, as shown in FIG. 3, in the case of a manually operated valve. The spring housing 38, for example, includes an air inlet 44 (where an air actuator is employed) and a yoke 46, and encases a compression spring 48 in mechanical communication with a diaphragm 50 and a valve stem 52. The valve stem 52 extends from the compression spring 48 through valve packing 54 and into the valve box 36. The valve packing 54 provides a fluidic seal around the stem 52, maintained as a positive seal by a packing nut 56. The packing 54 acts to prevent fluid from entering the spring housing 38 from the valve box 36. The valve box 36 includes an inlet pipe connection 58 in fluidic communication with an inlet chamber 60; an opening 62 through which the valve stem 52 extends, said opening 62 defined by inner wall structure such as an inner wall member 64; an escape chamber 66 fluidicly connected to an outlet pipe connection 68; and an annular-shaped stem cap 70, said stem cap 70 being disposed at the opposite side of the valve box 36 from the spring housing 38 and being integral with, or fastened (for example, with a gasket 69 there between, and by a plurality of stem cap bolts 71) to the rest of the valve box 36. These features shall be more fully explained below.

Referring to FIGS. 2 and 3, an important feature of the mechanism by which this invention operates is the two-position valve stem 52. The valve stem 52 can be considered to include a bottom portion 72, and a top portion 74 which is that part which proceeds into the spring housing 38. The bottom portion 72 of the valve stem 52 includes a duct system 76, which comprises a central axially-aligned bore 78; a flow restrictive device such as an orifice 86 axially-aligned with and at one end of said axial bore 78; and a plurality of holes which radially extend into the valve steam 52, including at least two feed holes 80, at least one escape hole 82, and at least one cleaning port 84. Where flow rates make it desirable to incorporate more than one of any of these holes, the arrangement shown in FIG. 3 may be implemented. This arrangement aids in preventing debris from blocking the flow path by having a plurality of diametrically-opposed holes. For example, twelve feed holes 80 are shown arranged in three axially-spaced groups 81 of four circumferentially-spaced holes, for example, at ninety degrees separation one from another. Note that the inlet chamber 60 must circumferentially surround the valve stem 52 to provide fluid to each of the feed holes 80. A plurality of escape holes is shown as one group 83 of circumferentially-spaced holes, and a plurality of cleaning ports is likewise shown as one group 85 of circumferentially-spaced holes.

The valve stem 52, in addition to including the duct system 76, has a main rod-shaped portion and two valve discs 88, 90 axially spaced along the rod by what shall be called the "travel" distance. The valve discs 88, 90 are annular protrusions that extend radially outward from the rod-shaped portion. The upper valve disc 88 is disposed or located between the feed holes 80, and the escape hole 82. The upper valve disc 88 has a tapered or flattened lower edge or seat 89. The lower valve disc 90 is axially located between the feed holes 80 and the cleaning port 84. The lower valve disc 90 has a tapered or flattened upper edge or seat 91. In a first position of the valve stem 52, shown in FIG. 3, the upper valve disc 88 is in its lowered position with its lower edge 89 adjacent to and touching with substantially fluid-impervious contact a top seat 92 of the inner wall member 64. In a second position, shown in FIG. 2, the lower valve disc 90 is in a raised position with its upper edge 91 adjacent to and touching with substantially fluid-impervious contact the lower seat 94 of the inner wall member 64.

In general operation and referring to FIG. 3, fluid enters the inlet pipe connection 58, which is shown on the left side of the valve box 36 from a connecting pipe which is not shown. The flow then passes through the inlet chamber 60 which is in direct fluidic communication with the bottom portion 72 of the valve stem 52. The flow stream from the inlet chamber 60 passes through the feed holes 80 and into the axial bore 78 of the valve stem 52. The flow is thereafter directed through the orifice 86 and out the escape hole 82 downstream to the escape chamber 66. From there the fluid enters the outlet pipe connection 68 which directs the flow to the outlet piping, not shown. The fluid is then routed to a vessel receiving the drain flow such as a condenser 18 or feedwater heater 22. The flow path just described is the forward-directed flow path of the valve in normal operation.

The cleaning or second position of the valve stem 52, shown in FIG. 2, permits debris blocking the feed holes 80 to be removed to the downstream side of the valve box 36 at a desirable time. When the valve stem 52 is moved upward (towards the spring housing 38), it carries the upper valve disc 88 away from the top seat 92 of the inner wall member 64, and quickly brings the lower valve disc 90 into contact with the bottom seat 94 of the inner wall member 64. In so doing, the escape hole 82 is moved up and within an annular-shaped blocking bushing 95 which substantially closes the escape hole 82 to fluid flow. Simultaneously, the cleaning port 84 moves above the valve body surface, designated in the drawings by the reference number 97, and is thus exposed to the upstream, higher-pressure zone of the flow in the inlet chamber 60. The flow of the fluid in the cleaning position is as follows: the fluid enters the cleaning port 84 from the inlet chamber 60, is directed up through the axial bore 78 and passes out through the feed hole 80 into the escape chamber 66.

The cleaning position of valve stem 52 also provides a second flow path which permits periodic, independent cleaning of the space between the end of the stem 52 and the inside of the stem cap 70. The fluid follows a flow path proceeding from the inlet chamber 60 through the cleaning port 84 into the axial bore 78 and out of the end 79 of the axial bore 78 into an area of the valve body 36 herein described as the cap chamber 96, said cap chamber 96 being the generally "U"-shaped space defined by and within the stem cap 70. It is important that the cap chamber 96 be free of debris, since any debris deposited in this area might eventually inhibit full travel of the valve stem 52 and thereby prevent it from moving sufficiently to allow proper seating of valve discs 88, 90. From the cap chamber 96 the fluid flows out of a cap outlet 98, and thereafter to the downstream piping. For example, the fluid flows from the cap outlet 98 through piping 100 to a port 102 in the outlet pipe connection 67. A solenoid-operated control valve 101 is, for example, disposed in the piping 100 to regulate the flow through the cap outlet 98. A plurality of fluid-impervious seal rings 103, disposed in the cap chamber 96 between the stem 52 and the side walls of the stem cap 70, prevent the flowing of steam from the inlet chamber 60 through the cap chamber 96 by a flow path other than that just described above.

Important limitations on the features of the invention are the number and relative diameters of the ducts. A plurality of feed holes 80 are employed, as described above. Since the feed holes 80 must be smaller than the orifice 86 so that it may trap any debris that will not pass through the orifice 86, if only a single feed hole were employed, it would effectively act as an undesirable flow restriction. The cumulative opening area of all the feed holes 80 combined must be greater than the opening area of the orifice 86. At the same time, each of the feed holes 80 must be smaller in diameter than either the axial bore 78, or the escape hole 82, as well as the orifice 86, so that, when the valve stem 52 is in its first position, any debris passing through the feed hole 80 will easily pass through the rest of the flow path. As an example, if the diameter of the orifice 86 is one-quarter inch, and each of the feed holes 80 have a three-sixteenth inch diameter, the minimal number of required feed holes 80 to handle the flow is calculated by dividing the area of the opening of the orifice 86 by the area of the opening of each of the feed holes 80. In this example, at least two feed holes 80 are needed. Likewise, the cleaning port 84 must be large than each of the feed holes 80; and must be the same size or preferably smaller than the cap outlet 98 and piping 100 so that any debris that passes through the cleaning port 84 will likewise pass through the rest of the flow path.

Figure 4:
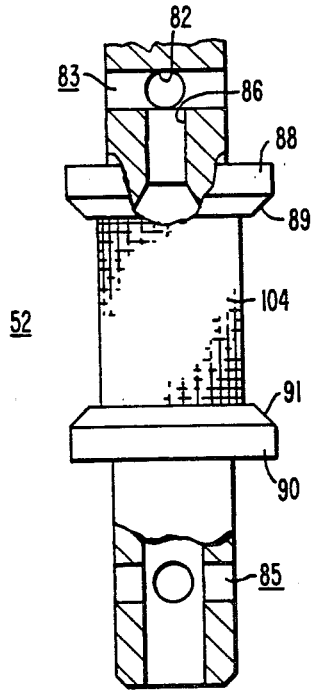
FIG. 4 is an enlarged sectional view, partially cutaway, of the self-cleaning valve stem shown in FIG. 3 incorporating a tubular strainer.

FIG. 4 shows a variation in the valve design in this invention, one that is of particular utility in orifice assemblies in which the orifice 86 is of small diameter, as for example in the pipe-heating method described in the Background. In this design, since each of the feed holes 80 must be smaller than the orifice 86 and said orifice 86 is extremely small, a great many of said feed holes 80 may be required to pass the flow. A problem is that the smaller the duct size, the more easily it is plugged. Therefore, in such designs this invention teaches the use of a tubular strainer 104 (for example, made from a fine-mesh wire screen or a cylindrical plate having a multiplicity of perforations) which is capable of fitting around the valve stem 52 between the valve discs 88, 90 such that the strainer 104 will not interfere with proper seating of said discs 88, 90. The tubular strainer 104, for example, may have thousands of small perforations and fit around a stem 52 having larger holes, not necessarily sized in accordance with the limitations discussed in the previous paragraph.

The valve 32 incorporating the invention and shown in the drawings is preferably actuated by a pneumatic operator; however it could be adapted to operate manually or otherwise automatically. With an automatic actuator 42, for example, a solenoid valve (not shown) could be energized remotely to route air, or other fluid if used, into the air inlet 44, to actuate the valve 32 in accordance with practices known in the art. Furthermore, an automatic operator 42 could be provided with an electrical means to control a tandem or multiplicity of said valves in a turbine from one control switch.

It should now be apparent that a self-cleaning orifice assembly has been provided. This invention facilitates the cleaning of small orifices, such as are used in turbines to drain pipes and vessels of unacceptable accumulations of water.

I claim:

1. A valve comprising:

(A) a valve casing including a spring housing and a valve body, said valve body having an inlet chamber, and an escape chamber, said chambers connected by an opening defined by an inner wall structure, said structure having a top seat about the top edge of the structure closest to the opening, and a bottom seat about the bottom edge of said structure closest to the opening;

(B) a two-position valve stem, extending from the spring housing and into the valve body, having a rod with a central axially-directed bore at its bottom portion, an orifice axially-aligned with said bore and disposed at said bore's top end, a plurality of radially-directed ducts, and two valve discs that protrude radially-outward from the rod and are disposed in axially-spaced relation; said ducts including at least two feed holes, at least one escape hole, and at least one cleaning port; said top disc having a seat along its lower edge and being disposed along said rod between said feed holes and said escape hole; and said bottom disc having a seat along its top edge and being disposed along said rod between said feed holes and said cleaning port; and (C) means for actuating said valve to move said valve stem from one of its positions to another;

whereby in said first position of said stem, said top disc's seat contacts said structure's top seat, and a fluid introduced into said inlet chamber for cleaning any debris that might have accumulated in the feed holes flows through said feed holes, said axial bore, said orifice, and then said escape hole to exit through said escape chamber; and whereby in said second position of said stem, said bottom disc's seat contacts said structure's bottom seat and said escape hole being received in an annular bushing in the valve body to substantially block the fluid from the inlet chamber via said escape hole, and the fluid introduced into said inlet chamber flows through said cleaning port, said axial bore, and said feed holes for cleaning any debris that might have accumulated in the feed holes to exit into said escape chamber.

2. The valve of claim 1 wherein said actuating means is an air actuator.

3. The valve of claim 1 wherein the actuating means is a handle which can be maually utilized to move the valve stem.

4. The valve of claim 1 further comprising a tubular strainer disposed between said inlet chamber and said valve stem.

5. The valve of claim 4 wherein the strainer surrounds a portion of said valve stem between the top and bottom disc, and said portion of said valve stem has at least one radial opening larger in diameter than said orifice.

6. The valve of claim 1 wherein the housing further comprises a bushing which substantially closes the escape hole to fluid flow when the valve is in its second position.

7. The valve of claim 1 wherein the ducts include a plurality of circumferentially-spaced feed holes, each feed hole being smaller in diameter than the orifice.

8. The valve of claim 1 wherein the diameter of each feed hole is smaller than the diameter of the axial bore, the orifice, or the escape hole; and whereby any debris that does pass through the feed holes will likewise pass through the rest of the flow path of the valve when its stem is in its first position.

9. The valve of claim 1 further comprising an annular-shaped stem cap disposed on the opposite side of the valve body from the spring housing; said cap having therein and defining a generally "U" shaped space capable of receiving a portion of the valve stem; whereby, when the valve stem is in its first position, the stem cap substantially closes the cleaning port.

10. The valve of claim 9 wherein the axial bore in the valve stem is open at the end of the valve stem; and the stem cap has a cap outlet; whereby, when the valve stem is in its second position, fluid is directed through the cleaning port, axial bore and cap outlet thereby cleaning any debris in the stem cap.

11. The valve of claim 9 wherein the stem cap is bolted to the valve body.

* * * * *